US005366204A

United States Patent [19]

Gigliotti, Jr. et al.

[11] Patent Number: 5,366,204

[45] Date of Patent: Nov. 22, 1994

[54] INTEGRAL INDUCTION HEATING OF CLOSE COUPLED NOZZLE

[75] Inventors: Michael F. X. Gigliotti, Jr., Scotia; Steven A. Miller, Amsterdam; Raymond A. White, Schenectady, all of N.Y.

[73] Assignee: General Electric Company, Schenectady, N.Y.

[21] Appl. No.: 898,602

[22] Filed: Jun. 15, 1992

[51] Int. Cl.[5] ..... B22F 9/08

[52] U.S. Cl. ..... 266/202; 222/593; 425/7

[58] Field of Search ..... 266/202; 222/593; 425/7

[56] References Cited

U.S. PATENT DOCUMENTS

| | | | |
|---|---|---|---|
| 3,817,503 | 6/1974 | Lafferty et al. | 425/7 |
| 3,988,084 | 10/1976 | Esposito et al. | 425/7 |
| 4,575,325 | 3/1986 | Duerig et al. | 425/7 |
| 4,619,597 | 10/1986 | Miller | 425/7 |
| 4,619,815 | 10/1986 | Robinson | 423/74 |
| 4,631,013 | 12/1986 | Miller | 425/7 |
| 4,762,553 | 8/1988 | Savage et al. | 425/7 |
| 4,801,412 | 1/1989 | Miller | 425/7 |
| 4,822,267 | 4/1989 | Walz | 425/7 |
| 5,201,359 | 4/1993 | McMullen | 222/593 |

FOREIGN PATENT DOCUMENTS

| | | | |
|---|---|---|---|
| 1-255608 | 10/1989 | Japan | 222/593 |

*Primary Examiner*—George Wyszomierski

*Attorney, Agent, or Firm*—R. Thomas Payne; James Magee, Jr.

[57] ABSTRACT

A method for improved atomization of molten metal having a melting point above 1000° C. is taught. The atomization is carried out in close coupled atomizer. The melt to be atomized is supplied from a reservoir where it is heated to a temperature slightly above the melting point. The molten metal from the reservoir is guided to the atomization zone by a ceramic melt guide tube. The atomization is accomplished with the aid of a shallow draft atomizing nozzle. The melt in the melt guide tube is heated with the aid of an induction coil which is disposed thereabout and between the reservoir and the shallow draft gas nozzle.

16 Claims, 3 Drawing Sheets

INTEGRAL INDUCTION HEATING OF CLOSE COUPLED NOZZLE

CROSS-REFERENCE TO RELATED APPLICATIONS

The present invention relates closely to commonly owned applications:

Ser. No. 07/920,075, filed Jul. 27, 1992;
Ser. No. 07/920,066, filed Jul. 27, 1992;
Ser. No. 07/928,581, filed Aug. 13, 1992;
Ser. No. 07/920,078, filed Jul. 27, 1992;
Ser. No. 07/928,596, filed Aug. 13, 1992;
Ser. No. 07/898,609, filed Jun. 15, 1992;
Ser. No. 07/920,595, filed Aug. 13, 1992;
Ser. No. 07/961,942, filed Oct. 16, 1992;
Ser. No. 07/920,067, filed Jul. 27, 1992;
Ser. No. 07/928,385, filed Aug. 12, 1992.

BACKGROUND OF THE INVENTION

The present invention relates generally to closely coupled gas atomization. More particularly, it relates to methods and means by which closely coupled gas atomization processing of high melting reactive molten metal can be started and carried out with significantly reduced melt superheat.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt orifice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1,000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy and the closely coupled atomization can result in a larger fraction of additive elements remaining in solid solution. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in precipitated form. Closely coupled atomization is more effective than remotely coupled atomization in producing the small powder sizes which will retain the additive elements in solid solution.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the closely coupled atomization process. This is particularly true for the finer particles of the powder formed from the atomization.

In this regard, it is known that the rate of cooling of a molten particle of relatively small size in a convective environment such as a flowing fluid or body of fluid material is determined by the properties of the droplet and of the cooling fluid. For a given atomization environment, that is one in which the gas, alloy, and operating conditions are fixed, the complex function relating all the properties can be reduced to the simple proportionality involving particle size shown below, $$T_p \alpha \frac{1}{D_p^2}$$

where:

$T_p$=cooling rate, and $D_p$=droplet diameter.

Simply put, the cooling rate for a hot droplet in a fixed atomization environment is inversely proportional to the diameter squared. Accordingly, the most important way to increase the cooling rate of liquid droplets is to decrease the size of the droplets. This is the function of effective gas atomization.

Thus it follows that if the average size of the diameter of a droplet of a composition is reduced in half, then the rate of cooling is increased by a factor of about 4. If the average diameter is reduced in half again, the overall cooling rate is increased 16 fold.

Since high cooling rates are predominantly produced by reducing droplet size, it is critical to effectively atomize the melt.

The Weber number, We, is the term assigned to the relationship governing droplet breakup in a high velocity gas stream. The Weber number may be calculated from the following expression:

$$We = \frac{\rho V^2 D}{\sigma}$$

where

Σ and V are the gas density and velocity, and

σ and D are the droplet surface tension and diameter.

When the We number exceeds ten, the melt is unstable and will breakup into smaller droplets. The dominant term in this expression is gas velocity and thus in any atomization process it is essential to have high gas velocities. As described in the commonly owned U.S. Pat. No. 4,631,013 the benefit of close coupling is that it maximizes the available gas velocity in the region where the melt stream is atomized. In other words, the close coupling is itself beneficial to effective atomization because there is essentially no loss of gas velocity before the gas stream from the nozzle impacts the melt stream and starts to atomize it.

Because of this relationship of the particle size to the cooling rate, the best chance of keeping a higher concentration of additive elements of an alloy, such as the strengthening additives, in solid solution in the alloy is to atomize the alloy to very small particles. Also, the microstructure of such finer particles is different from that of larger particles and often preferable to that of larger particles.

For an atomization processing apparatus, accordingly the higher the percentage of the finer particles which are produced the better the properties of the articles formed from such powder by conventional powder metallurgical techniques. For these reasons, there is strong economic incentive to produce finer particles through atomization processing.

As pointed out in the commonly owned prior art patents above, the closely coupled atomization technique results in the production of powders from metals having high melting points with higher concentration of fine powder. For example, it was pointed out therein that by the remotely coupled technology only 3% of powder produced industrially is smaller than 10 microns and the cost of such powder is accordingly very high. Fine powders of less than 37 microns in diameter of certain metals are used in low pressure plasma spray applications. In preparing such powders by remotely coupled techniques, as much as 60–75% of the powder must be scrapped because it is oversized. This need to selectively separate out only the finer powder and to scrap the oversized powder increases the cost of useable powder.

Further, the production of fine powder is influenced by the surface tension of the melt from which the fine powder is produced. For melts of high surface tension, production of fine powder is more difficult and consumes more gas and energy. The remotely coupled industrial processes for atomizing such powder have yields of less than 37 microns average diameter from molten metals having high surface tensions of the order of 25 weight % to 40 weight %. A major cost component of fine powders prepared by atomization and useful in industrial applications is the cost of the gas used in the atomization. Using remotely coupled technology, the cost of the gas increases as the percentage of fine powder sought from an atomized processing is increased. Also, as finer and finer powders are sought, the quantity of gas per unit of mass of powder produced by conventional remotely coupled processing increases. The gas consumed in producing powder, particularly the inert gas such as argon, is expensive.

As is explained more fully in the commonly owned patents referred to above, the use of the closely coupled atomization technology of those patents results in the formation of higher concentrations of finer particles than are available through the use of remotely coupled atomization techniques. The texts of the commonly owned patents are incorporated herein by reference.

As is pointed out more fully in the commonly owned U.S. Pat. No. 4,631,013, a number of different methods have been employed in attempts to produce fine powder. These methods have included rotating electrode process, vacuum atomization, rapid solidification rate process and other methods. The various methods of atomizing liquid melts and the effectiveness of the methods is discussed in a review article by A. Lawly, entitled "*Atomization of Specialty Alloy Powders*", which article appeared in the Jan. 19, 1981 issue of the Journal of Metals. It was made evident from this article and has been evident from other sources that gas atomization of molten metals produces the finest powder on an industrial scale and at the lowest cost.

It is further pointed out in the commonly owned U.S. Pat. No. 4,631,013 patent that the close coupled processing as described in the commonly owned patents produces finer powder by gas atomization than prior art remotely coupled processing.

A critical factor in the close coupled gas atomization processing of molten metals is the melting temperature of the molten metal to be processed. Metals which can be melted at temperatures of less than 1000° C. are easier to atomize than metals which melt at 1500° or 2000° C. or higher, largely because of the degree of reactivity of the metal with the atomizing apparatus at the higher temperatures. The nature of the problems associated with close coupled atomization is described in a book entitled "*The Production of Metal Powders by Atomization*", authored by John Keith Beddow, and printed by Haden Publishers, as is discussed more fully in the the commonly owned U.S. Pat. No. 4,631,013.

The problems of attack of liquid metals on the atomizing apparatus is particularly acute when the more reactive liquid metals or more reactive constituent of higher melting alloys are involved. The more reactive metals include titanium, niobium, aluminum, tantalum, and others. Where such ingredients are present in high melting alloys such as the superalloys, the tendency of these metals to attack the atomizing apparatus itself is substantial. For this reason, it is desirable to atomize a melt at as low a temperature as is feasible.

One of the problems which accompanies the use of the conventional close coupled apparatus such as is described in the above patents is a tendency for the melt to freeze up in the melt delivery tube and prior to its entry into the atomization zone disposed immediately below the exit lower end of the melt delivery tube.

BRIEF STATEMENT OF THE INVENTION

In one of its broader aspects, objects of the present invention can be achieved by providing close coupled gas atomization apparatus for atomization of metals having melting temperatures above 1000° C. The apparatus includes reservoir means for supplying melt to be atomized at a relatively low superheat of less than 50° C. The apparatus also includes melt guide tube means for guiding the melt as a stream from the supply means and for introducing the stream into an atomization zone. The apparatus also includes induction coil means disposed to be operatively coupled to the melt in said melt guide tube means and power supply means to supply power to said coil. The melt guide tube means has a lower end which is inwardly tapered to a melt orifice immediately above the atomization zone. The atomization apparatus also includes gas supply means disposed at least partially about the melt guide tube orifice for supplying atomizing gas and for directing the atomizing gas into the atomization zone to atomize the melt flowing from the melt guide tube. The gas supply means includes at least one gas inlet, a gas manifold to distribute gas around the melt guide tube, at least one gas orifice poised above and aimed at the atomization zone and at least one gas shield to guide gas from the manifold to at least one of the orifices. The gas shield has at least one surface disposed at least partially vertically to guide gas from the manifold inward toward the melt guide tube and downward toward the atomization zone. The gas shield is poised proximate the lower end of the melt guide tube.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
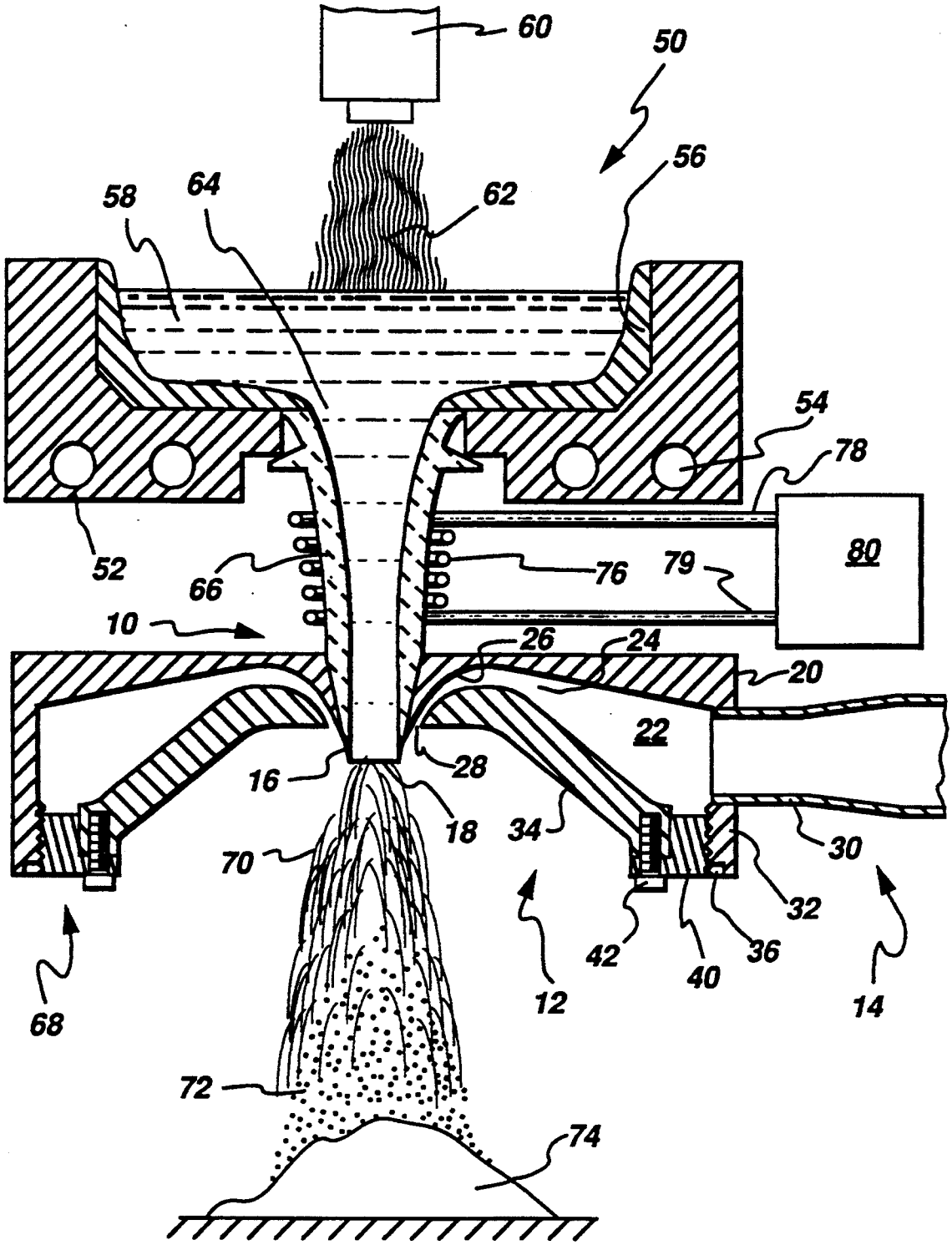
FIG. 1 is a sectional view of a cold hearth apparatus operatively linked to an induction heated melt guide tube and to shallow close coupled nozzle atomization apparatus.

As has been evident from a number of journal articles and other sources, the powder metallurgy industry has been actively driving toward greatly increased usage of fine powders over the past two decades. One of the reasons is the recognition that superior metallurgical properties are achieved because of the higher solubility of strengthening and similar additives in alloys which are converted into the very fine powder as discussed above. Generally, greater strength, toughness, and fatigue resistance can be attained in articles prepared via the fine powder route for such alloys as compared to the properties found in the same alloys prepared by ingot or other conventional alloy technology. These improvements in properties come about principally due to the extensions of elemental solubility in the solid state which are obtainable via fine powder processing. In other words, the additives preferably remain in solid solution or in tiny nucleated precipitate particles in the host alloy metal and impart the improved properties while in this state as also discussed above. Generally, the finer the powder, the more rapidly it is solidified and the more the solubility limits are extended. In addition, the limits on the alloying additions processed through the fine powder route are increased.

A nemesis of the improved property achieved through fine powder processing however is contamination by foreign materials which enter the powder prior to consolidation. The contamination acts to reduce the local strength, fatigue resistance, toughness, and other properties and thus the contamination becomes a preferred crack nucleation site. Once nucleated, the crack can continue to grow through what is otherwise sound alloy and ultimately results in failure of the entire part.

What is sought pursuant to the present invention is to provide a process capable of manufacture of powder that is both finer and cleaner, and to do so on an industrial scale and in an economical manner.

In order to accomplish this result, one of the problems which must be overcome is to reduce the major source of defects introduced by the prior art conventional powder production process itself. In the conventional powder production process, the alloy to be atomized is first melted in ceramic crucibles and then is poured into a ceramic tundish often by means of a ceramic launder and is finally passed through a gas atomization nozzle employing ceramic components. In the case in which the alloy to be atomized is a superalloy, it is well-known to contain highly reactive components such as titanium, zirconium, molybdenum, and aluminum, among others, and that these metals are highly reactive and have a strong tendency to attack the surfaces of ceramic apparatus which they contact. A typical liquidus temperature of a nickel base superalloy is about 1350° C., for example. The attack can result in formation of ceramic particles and these particles are incorporated into the melt passing through the atomization process and ultimately in the final powder produced by the atomization process. These ceramic particles are a major source of the foreign matter contamination discussed above.

One way in which the conventional extensive use of ceramic containment and ceramic surfaces can be eliminated is through the use of the so-called cold hearth melting and processing apparatus. In this known cold hearth apparatus, a copper hearth is cooled by cold water flowing through cooling channels embedded in the copper hearth. Because the hearth itself is cold, a skull of the metal being processed in the hearth is formed on the inner surface of the hearth. The liquid metal in the hearth thus contacts only a skull of the same solidified metal and contamination of the molten metal by attack of ceramic surfaces is avoided. However, it has now been found that the use of cold hearth processing results in a supply of molten metal which has a very low superheat in comparison to the superheat of metal processed through the prior art ceramic containment devices. The superheat is defined here as a measure of the difference between the actual temperature of the molten alloy melt being processed and the melting point or more specifically the liquidus temperature of that alloy. For apparatus employed in close coupled atomization as described in the commonly owned patents referred to above, higher superheats in the range of 200°-250° C. are employed to prevent the melt from freezing off in the atomization nozzle. For apparatus which is more loosely coupled than that described in these patents, a 100°-250° C. or higher superheat is employed to prevent a melt from excessive loss of heat and freezing during processing.

An important point regarding the processing of melts with low superheats of 50° C. or less is that strengthening and other additives are as fully dissolved in a melt having a low superheat as they are in a melt having a high superheat. Accordingly, improvements in properties of fine powders, of less than 37 micron diameter for example, is found in essentially equal measure in fine powders prepared from melts with low superheats as in fine powders prepared from melts having high superheats.

In using a cold hearth containment to provide a reservoir of molten metal for atomization, it has been found that application of heat to the upper surface of the melt is economic and convenient. Such heat may be applied, for example, by plasma arc mechanisms, by electron beam or by other means. Because a melt contained in a cold hearth loses heat rapidly to the cold hearth itself, it has not been possible to generate significant superheat in the melt. Measured superheats of melts contained in cold hearth indicates that time averaged superheats of up to about 50° C. in magnitude are feasible. Because the melts supplied from cold hearth sources have relatively low superheat of the order of 10°-50° C., there is a much higher tendency for such melts to freeze up in the nozzle of an atomization apparatus. For this reason, attempts to atomize melts having low superheats of less than 50° C. at standard flow rates through the closely-coupled atomization apparatus of the commonly owned patents have failed due to freeze-up of the melt in the atomization nozzle. Herein lies a critical distinction between the processing of melt prepared for atomization in the older ceramic systems as compared to the new cold hearth approach described herein. In practical terms, in the old ceramic system any desired amount of superheat could be attained. Thus, heat extraction by the gas plenum was never addressed in the plenum design. It was possible to simply increase the superheat of the melt to compensate for any heat extraction by the gas plenum. However, in the new cold hearth systems, we have found it impossible to date to produce a superheat of more than 50°-70° C. and we have found this superheat to be insufficient to prevent freeze-off in close coupled atomization using the prior art nozzles of the commonly owned patents referred to above. We have now devised a new gas plenum design that permits atomization with only 50°-70° C. or less superheat. Close coupled atomization of a melt with such low superheat was previously deemed impossible. One important aspect of this invention was to reduce heat flow from the melt to the cold gas plenum. In part, this was accomplished by reducing the vertical dimension of the plenum in the region where the melt must pass thru the plenum.

The U.S. Pat. Nos. 4,578,022; 4,631,013; and 4,778,516; provide discussions of concern with this problem. The text of these patents address and solve many of the issues in the atomization of high temperature melts and the production of fine powder. Noticeably missing, however, is discussion of the issue of freeze-off of the melt stream due to the lack of superheat and the discussion of system limitations that prevent increasing the melt superheat. This is because prior work was done with ceramic melting systems, where for conventional alloys there are no practical limits to how much superheat can be provided. Only with the recent advent of cold hearth melting has it become necessary to solve the problem of increased freeze off due to low superheat. Thus, while the devices disclosed in these and other prior art patents have geometries that are superficially similar to those disclosed herein, they do not make atomization of melts with low superheats of the order of 10°-50° C. feasible.

However, we have found that although all of the alloy ingredients are fully in solution in the melts at and above the liquidus temperature, nevertheless the atomization process can be quite sensitive to the actual temperature of a melt for a set of atomization conditions. In particular, we have found that the fineness or coarseness of the particles formed by an atomization of a melt can be altered by temperature differences of as little as 100° C. for certain alloy compositions such as superalloy compositions depending on the properties of the melt. Thus, based on our studies we have found that the production of fines, that is, the proportion of a powder sample which has a particle size less than 37 microns for example, can be increased by approximately 5% to 10% where the temperature of the melt is at a 100° C. higher superheat. We have also found that as much as 200° C. of superheat can be added to a melt passing through a melt guide tube at a rate of 15 pounds per minute.

Accordingly, what we have found is that the most effective combination of processing of a superalloy, for example by close coupled atomization, is the processing of the melt through cold hearth apparatus to have a superheat below about 50° C. and by then increasing the superheat of the melt as it passes to the atomization zone by putting heat into the melt as it passes through the melt guide tube and by combining these measures with a reduction in the loss of heat from the melt as part of the close coupled atomization operation. The several combined aspects of the present invention are now discussed starting with the processing of the highly reactive metal alloys through the cold hearth apparatus.

Figure 3:
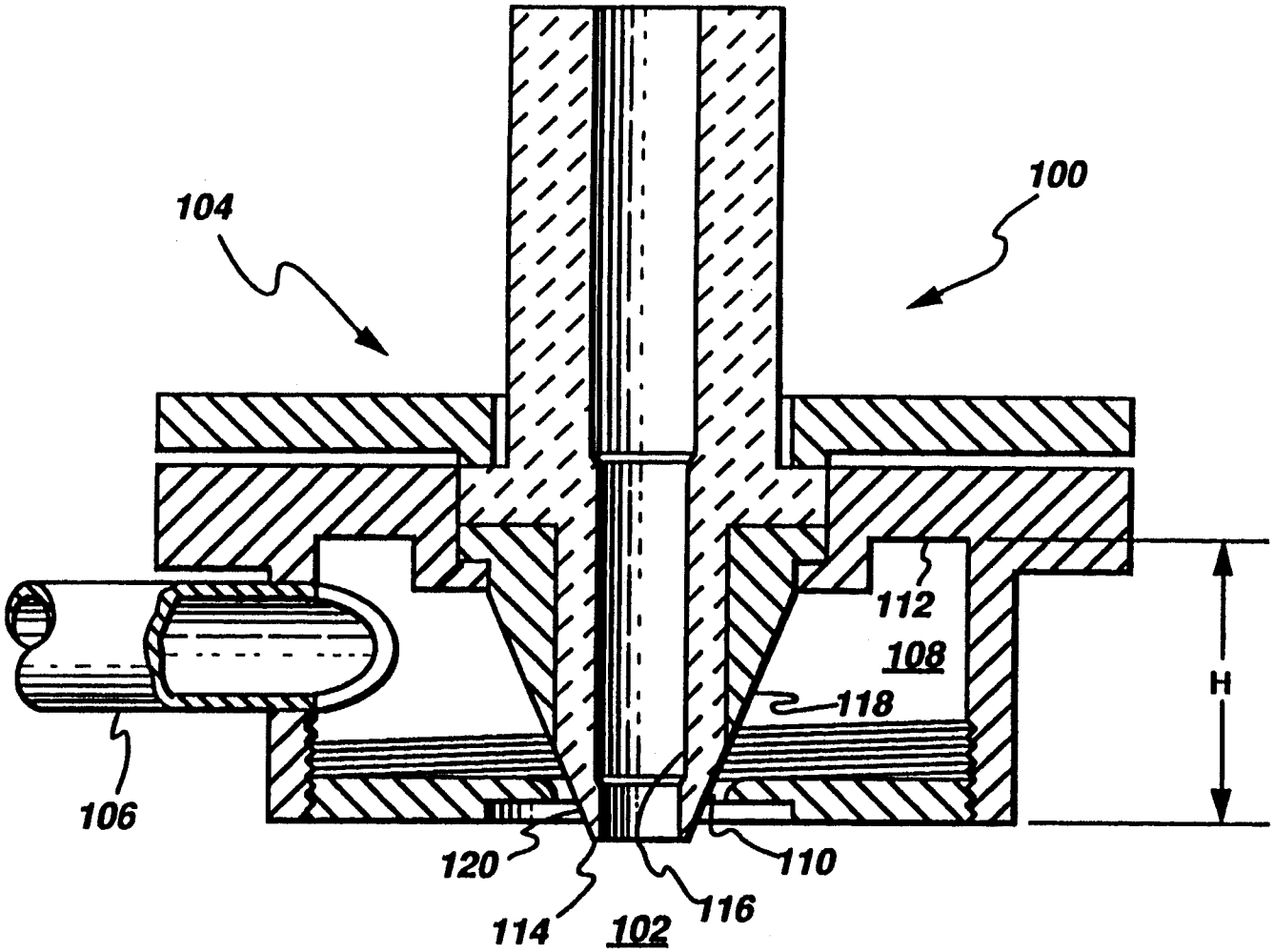
FIG. 3 is a vertical sectional view of a prior art close coupled atomization apparatus.

Pursuant to the present invention, atomization apparatus is employed which has a significantly shorter parallel flow of melt and atomizing gas than the prior art structure of FIG. 3. Such a structure is taught in copending application Ser. No. 07/920,066, filed Jul. 27, 1992. In the copending application, the temperature of melt which is processed from a cold hearth apparatus is less than 50° C. above the melting point or more specifically the liquidus temperature of the melt.

We have now found that for certain alloys, while the processing of melt with low superheat through an atomization operation is a significant and novel accomplishment, the particle size of the powder product of the atomization is not as desirable as the powder product of atomization of melt carried out at a higher temperature. What we have found to be quite valuable and desirable in operation of an atomizer employing a cold hearth as the source of melt to be atomized is to increase the temperature of the certain melts after they have left the cold hearth and before they emerge from the melt guide tube into the close coupled atomization zone.

To accomplish this improvement in increasing the proportion of finer powder produced by the atomization process, heat is added to the melt as it passes from the cold hearth melt supply and passes through the melt guide tube. One manner in which this is carried out is described with reference to FIG. 1. Referring now specifically to FIG. 1, this figure is a semischematic version of close coupled atomization apparatus as provided pursuant to the present invention. It should be pointed out that the various elements of the structure are not illustrated in the proportion in which they exist in an actual apparatus but are modified for purpose of clarity of illustration. Thus, the hearth and reservoir of molten metal are shown on reduced size scale relative to the atomization apparatus and conversely the atomization apparatus is shown on a large scale relative to the hearth and reservoir of melt to be atomized.

The invention and the features thereof are now described with reference to FIGS. 1 and 2.

In this regard, reference is made next to FIG. 1. In FIG. 1 a melt supply reservoir and a melt guide tube are shown semischematically. The figure is semischematic in part in that the hearth 50 and tube 66 are not in size proportion in order to gain clarity of illustration. The melt supply is from a cold hearth apparatus 50 which is illustrated undersize relative to tube 66. This apparatus includes a copper hearth or container 52 having water cooling passages 54 formed therein. The water cooling of the copper container 52 causes the formation of a skull 56 of frozen metal on the surface of the container 52 thus protecting the copper container 52 from the action of the liquid metal 58 in contact with the skull 56. A heat source 60, which may be for example a plasma gun heat source having a plasma flame 62 directed against the upper surface of the liquid metal of molten bath 58, is disposed above the surface of the reservoir 50. The liquid metal 58 emerges from the cold hearth apparatus through a bottom opening 64 formed in the bottom portion of the copper container 52 of the cold hearth apparatus 50. Immediately beneath the opening 64 from the cold hearth, a melt guide tube 66 is disposed to receive melt descending from the reservoir of metal 58. The tube 66 is illustrated oversize relative to hearth 50 for clarity of illustration.

The melt guide tube 66 is positioned immediately beneath the copper container 52 and is maintained in contact therewith by mechanical means, not shown, to prevent spillage of molten metal emerging from the reservoir of molten metal 58 within the cold hearth apparatus 50. The melt guide tube 66 is a ceramic structure which is resistant to attack by the molten metal 58. Tube 66 may be formed of boron nitride, aluminum oxide, zirconium oxide, or other suitable ceramic material. The molten metal flows down through the melt guide tube to the lower portion thereof from which it can emerge as a stream into an atomization zone.

Melt passes down through the melt guide tube and is atomized by a close coupled atomization apparatus 68.

Referring now again specifically to FIG. 1, there are three structural elements in the atomization structure of FIG. 1. The first is a central melt guide tube structure 10. The second is the gas atomization structure 12, and the third is the gas supply structure 14.

The melt supply structure 10 is essentially the lower portion of the melt guide structure 66. The melt guide tube is a ceramic structure which ends in an inwardly tapered lower end 16, terminating in a melt orifice 18. The gas atomization structure 12 includes a generally low profile housing 20 which houses a plenum 22 positioned laterally at a substantial distance from the melt guide tube 10. The gas from plenum 22 passes generally inwardly and upwardly through a narrowing neck passageway 24 into contact with a gas shield portion 26 where the gas is deflected inward and downward to the orifice 28 and from there into contact with melt emerging from the melt orifice 18.

The plenum 22 is supplied with gas from a gas supply not shown through the gas supply pipe 14. Pipe 14 has necked down portion 30 where it is attached to the wall 32 of the housing 20. The lower portion of plenum 22 is a shaped adjustable annular structure 34 having a threaded outer ring portion 36 by which threaded vertical movement is accomplished. Such movement is accomplished by turning the annular structure 34 to raise or lower it by means of the threads at the rim of ring 36 thereof. A ring structure 40 is mounted to annular structure 34 by conventional bolt means such as 42.

The gas atomized plume of molten metal 70 passes down to a region where the molten droplets solidify into particles 72 and the particles accumulate in a pile 74 in a receiving container.

Heat is added to the melt as it passes from the source of melt 58 with low super heat to the close coupled atomization apparatus 68. The heat is added as the melt passes through tube 66 by means of induction coil 76. Coil 76 receives energy from source 80 through connecting conductors 78 and 79.

Based on experiments we have made, it is our conclusion that where the temperature of the melt flowing down through melt guide tube 66 is increased by approximately 100° C. for a sample of superalloy René 95, there is an increase in the percentage of fines of the product formed by the atomization of approximately between 5–10%. Such an increase is very significant in an industrial process for production of fine powder as described in the background statement of this application.

Figure 2:
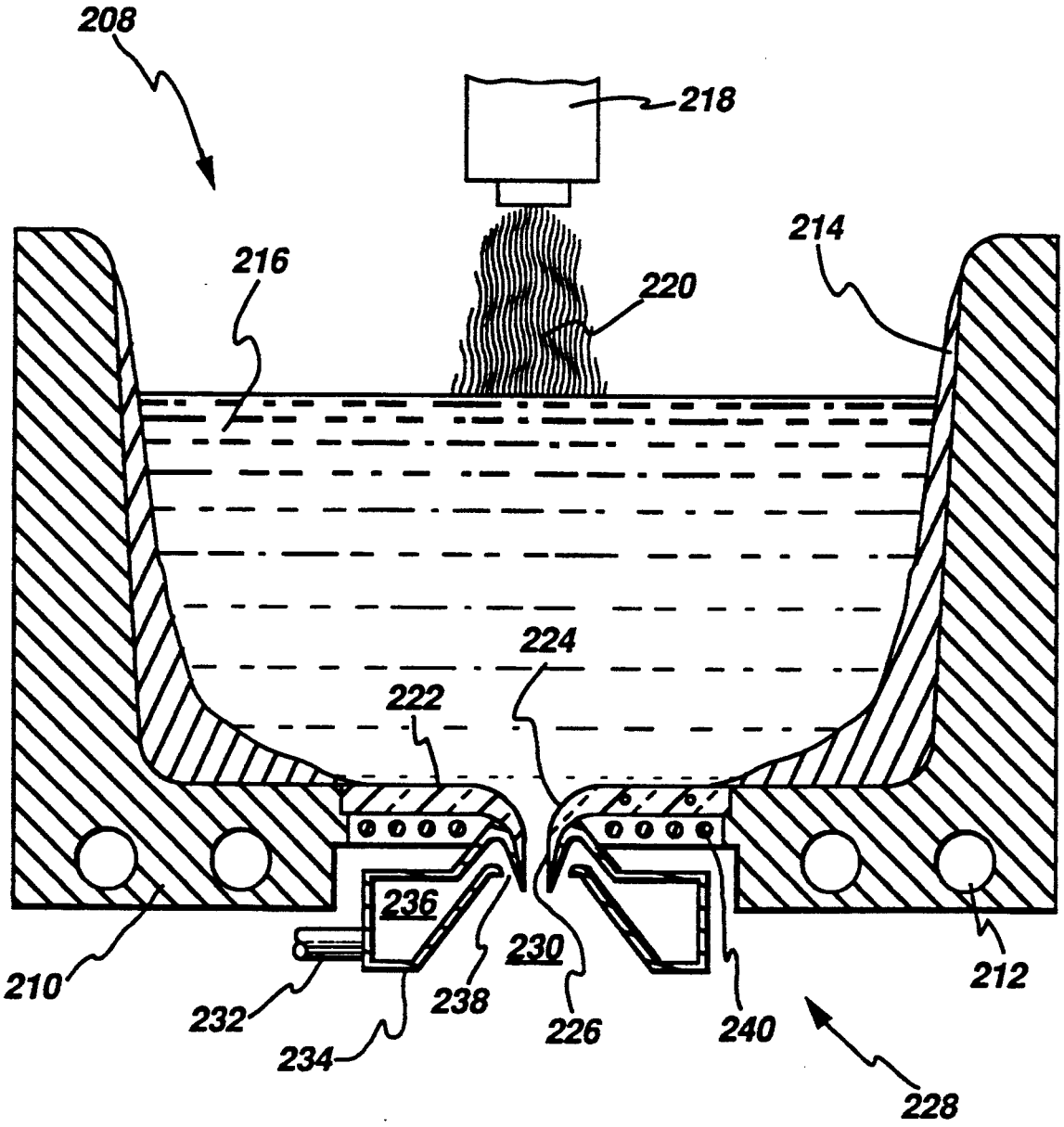
FIG. 2 is a sectional view of an apparatus similar to that of FIG. 1 with the exception that the induction coil is more shallow and the atomization apparatus is positioned closer to the cold hearth reservoir.

Referring next now to FIG. 2, an alternative form of a structure having an induction coil associated with a melt reservoir and with a closely coupled atomization apparatus is displayed. The components of the FIG. 2 illustration are closer in proportion to the actual components of such a structure than the components of the FIG. 1 illustration. However, the illustration is also semischematic in that the components are illustrated principally to make clear the inventive concept which is involved.

A cold hearth apparatus 208 is shown in vertical section. A copper container 210 is equipped with cooling passages 212 such as may be cooled by flowing water therethrough. A skull 214 forms on the inner surface of the container 210 by freezing of the melt 216 on the cooled walls. A heat source 218 such as a plasma gun is employed to direct a plasma flame 220 on the upper surface of melt 216 to provide heat thereto. A ceramic insert 222 is mounted in a conforming recess in an opening in the lower wall of container 210. The insert 222 has a center opening 224 through which melt flows into a melt guide tube portion 226 of the insert to provide a stream of melt which passes into an atomization zone 230. Once in the atomization zone atomization occurs in a manner similar to that illustrated in FIG. 1 and tiny liquid metal droplets are formed and collected on a receiving surface as described above with reference to FIG. 1.

The atomizing apparatus 228 includes a gas supply 232 and a generally annular manifold 234. Gas enters the manifold 234 and is distributed in a plenum 236 to a gas orifice 238 where the gas passes down into the atomization zone and into contact with melt flowing into the zone through the melt guide tube 226. A number of coils 240 are mounted immediately beneath the insert 222 and are connected to a energy source such as 80 of FIG. 1 through means not shown. The conductive turns 240 of the induction coil are seen to be mounted in a generally flat or pancake configuration. Because of this flat array of the strands 240 of the induction coil, heat is delivered to the melt in contact with the insert 222 and also to the manifold 234. The net result of the imparting of energy from the coil 240 to the melt exiting the cold hearth 208 through orifice 224 and the heating of the manifold 234 is that the atomization occurs at a higher temperature than would be the case if the coil 240 were absent. The higher temperature atomization leads to the formation of a higher percentage of finer particles as explained above with reference to the atomization processing described relative to FIG. 1.

As indicated above, one result of successfully carrying out the atomization at a higher temperature is to increase the percentage of finer particles which are formed from the atomization process.

Because the manifold 234 receives heat energy from coil 240, it is preferred to form the manifold of a metal which can be heated to a high temperature without deforming. High melting point alloys such as the superalloys or titanium, or refractory metals such as tantalum, niobium, and others are useful for this purpose.

Because of the high power densities which are achievable with the use of induction coils, it is possible to preheat a melt guide tube to a greater temperature than may be feasible with other heating methods. Preheat temperatures above the melting point of superalloys at about 1350° C. are easily attainable if a refractory metal plenum assembly is employed in combination with the melt guide tube as described above. Further, through the use of this arrangement, the preheating of the melt guide tube may be extended all the way down to the melt guide tube tip. These are distinct advantages made possible by the combination of induction coil elements with the structure of the closely coupled nozzles of low profile as described herein. Advantages of avoidance of freeze-up during start-up as well as avoidance of some of the problems during continuous running are made possible. In addition as noted above, it is also possible to add heat to the melt as it passes to an atomization zone. Benefits which may be obtained from operation in this manner include the production of a higher percentage of fines where the temperature of the melt passing to the atomization zone is increased significantly to the extent of 30° C. or more up to 200° C. or more depending on the design of the coil and of the energy supplied to the coil.

What is claimed is:

1. A close coupled gas atomization system for the atomization of metals having melting temperatures above 1000° C. comprising:

a melt reservoir for supplying a melt of molten metal with a superheat of about 10° C. to about 70° C.;

a melt guide tube, operatively connected to the melt reservoir, for guiding the melt as a stream into an atomization zone;

induction coil means, operatively coupled to the melt guide tube, so that the temperature of the melt flowing through the melt guide tube is increased by at least about 100° C.; and gas supply means, operatively positioned relative to the melt guide tube, for supplying atomizing gas into the atomization zone.

2. The system of claim 1, wherein the induction coil is of generally flat configuration.

3. The system of claim 2, wherein the induction coil is of generally tubular configuration.

4. The system of claim 1, wherein the coil is capable of generating heat sufficient to raise the temperature of the melt in the melt guide tube by about 100° C. to about 300° C.

5. A close coupled gas atomization system for the atomization of metals having melting temperatures above 1000° C., the system comprising:

means for supplying melt to be atomized at a superheat of at most 50° C.;

a melt guide tube having an orifice, operatively connected to the melt supply means, for delivering the melt to an atomization zone;

gas supply means, operatively positioned relative to the melt guide tube orifice, for supplying atomizing gas at a temperature significantly below that of the melt, into the atomization zone so that the melt flowing thereinto from the melt guide tube is atomized, the gas supply means including at least one gas inlet, a gas manifold for distributing gas around the melt guide tube, at least one gas orifice operatively positioned relative to the atomization zone; and melt guide tube heating structure, operatively connected to the melt guide tube, for heating the melt to a temperature at least about 100° C. higher before exiting the guide tube then upon entry therein.

6. The system of claim 5, wherein during the atomization process, the heating structure transfers sufficient heat to the melt guide tube to avoid freeze-off therein.

7. A system for the close coupled gas atomization of metals having melting temperatures above 1000° C., the system comprising:

means for supplying melt to be atomized at a superheat from about 10° C. to about 70° C.;

a melt guide tube, operatively connected to a supply of melt for delivering the melt to an atomization zone;

gas distribution structure, operatively positioned relative to the melt guide tube for directing atomizing gas to the atomization zone; and heat transfer means, operatively positioned relative to the melt guide tube, for transferring sufficient heat to the melt as the melt traverses the melt guide tube to raise the melt temperature by about 100° C. to about 300° C. such that flow of the melt through the melt guide tube to the atomization zone is maintained during normal operation of the system thereby avoiding freeze-off.

8. The system of claim 7, wherein the heat transfer means comprises:

induction coil means, operatively positioned between a cold hearth and the melt guide tube.

9. The system of claim 8, wherein the induction coil means has a generally flat configuration.

10. The system of claim 8, wherein the induction coil means has a generally tubular configuration.

11. The system of claim 8, wherein the induction coil means is capable of transferring sufficient heat to the melt as the melt traverses the melt guide tube to raise the melt temperature by about 100° C. to about 300° C.

12. The system of claim 8, wherein the gas distribution structure further comprises a plenum assembly.

13. The system of claim 12, wherein both the plenum assembly and the melt guide tube are preheated to about 1350° C. by the induction coil means.

14. The system of claim 13, wherein the induction coil means is capable of preheating the melt guide tube from top to bottom such that freeze-off during startup is reduced.

15. The system of claim 13, wherein the induction means is capable of preheating the melt guide tube from top to bottom such that freeze-off during continuous operations is reduced.

16. The system of claim 7, wherein the proportion of the powder produced thereby of particles having a size less than 37 microns is increased by about 5% to about 10% over those produced when the temperature of the melt is not increased.

* * * * *